US011919671B2

(12) United States Patent
Dahl et al.

(10) Patent No.: US 11,919,671 B2
(45) Date of Patent: Mar. 5, 2024

(54) DEVICE, SYSTEM AND METHOD FOR REMOVING STRAPS FROM BOXES

(71) Applicant: MAREL SALMON A/S, Stovring (DK)

(72) Inventors: Mads Aagaard Dahl, Bronderslev (DK); Peter Thisted Svoldgaard, Stovring (DK)

(73) Assignee: MAREL SALMON A/S, Stovring (DK)

( * ) Notice: Subject to any disclaimer, the term of this patent is extended or adjusted under 35 U.S.C. 154(b) by 0 days.

(21) Appl. No.: 17/760,149

(22) PCT Filed: Feb. 5, 2021

(86) PCT No.: PCT/EP2021/052781
§ 371 (c)(1),
(2) Date: Aug. 4, 2022

(87) PCT Pub. No.: WO2021/156426
PCT Pub. Date: Aug. 12, 2021

(65) Prior Publication Data

US 2023/0079406 A1 Mar. 16, 2023

(30) Foreign Application Priority Data

Feb. 5, 2020 (EP) ..... 20155544

(51) Int. Cl.
*B65B 69/00* (2006.01)

(52) U.S. Cl.
CPC ..... *B65B 69/0025* (2013.01)

(58) Field of Classification Search
CPC ..... B65B 69/0025
USPC ..... 53/492, 381.1, 381.2
See application file for complete search history.

(56) References Cited

U.S. PATENT DOCUMENTS

| | | | |
|---|---|---|---|
| 4,773,148 | A | 9/1988 | Ohya et al. |
| 4,995,784 | A | 2/1991 | Boisseau |
| 5,297,329 | A | 3/1994 | Santin et al. |
| 6,401,582 | B1 | 6/2002 | Noe et al. |
| 7,021,033 | B2 | 4/2006 | Close et al. |

(Continued)

FOREIGN PATENT DOCUMENTS

| | | | |
|---|---|---|---|
| CN | 106218999 | A | 12/2016 |
| CN | 109229672 | A | 1/2019 |
| CN | 109677719 | A | 4/2019 |

(Continued)

OTHER PUBLICATIONS

European Search Report from corresponding EP Application No. EP 20155544.8, dated Jul. 21, 2020.

(Continued)

*Primary Examiner* — Anna K Kinsaul
*Assistant Examiner* — Luis G Del Valle
(74) *Attorney, Agent, or Firm* — Workman Nydegger

(57) ABSTRACT

A device for removing straps from boxes, such as a strap encircling a box, includes at least one tentacle or gripping device for creating contact to a strap which is to be removed from a box, at least one first guide for guiding the strap away from the tentacle or gripping device, and at least one first guide drive for driving the first guide. A strap to be removed may be cut before or during the time a tentacle or gripping device engages with the strap.

14 Claims, 7 Drawing Sheets

(56) References Cited

U.S. PATENT DOCUMENTS

| | | | | |
|---|---|---|---|---|
| 2012/0255264 | A1* | 10/2012 | Stone | B65B 69/0025 53/381.2 |
| 2021/0086936 | A1* | 3/2021 | Nishigaito | B65B 69/0033 |

FOREIGN PATENT DOCUMENTS

| | | | |
|---|---|---|---|
| CN | 109677720 | A | 4/2019 |
| CN | 109677721 | A | 4/2019 |
| DE | 4432267 | A1 | 12/1995 |
| DE | 10205462 | C1 | 9/2003 |
| DE | 102005055803 | A1 | 5/2007 |
| DE | 202011051411 | U1 | 1/2012 |
| EP | 2767372 | A1 | 8/2014 |
| JP | S63317437 | A | 12/1988 |
| JP | H01070340 | A | 3/1989 |
| JP | H05075622 | B2 | 10/1993 |
| JP | H05085410 | B | 12/1993 |
| JP | 2639656 | B | 8/1997 |
| JP | S63317434 | A | 12/1998 |
| SE | 435608 | B | 10/1984 |
| SE | 454978 | B | 6/1988 |
| WO | 2008052175 | A1 | 5/2008 |
| WO | 2009123994 | A2 | 10/2009 |
| WO | 2015075101 | A1 | 5/2015 |
| WO | 2018019782 | A1 | 2/2018 |

OTHER PUBLICATIONS

International Search Report from corresponding PCT Application No. PCT/EP2021/052781, dated Apr. 14, 2021.

* cited by examiner

DEVICE, SYSTEM AND METHOD FOR REMOVING STRAPS FROM BOXES

FIELD OF THE INVENTION

The present invention relates to a device for removing straps from boxes, such as straps used around boxes which is to be transported. Straps are removed before un-packaging.

BACKGROUND

Different kinds of products are packaged in boxes which are secured by straps around the boxes to avoid opening of the boxes. To open and empty the boxes the straps need to be removed. When having large batches of boxes ensured by straps the strap removal is a time-consuming process if performed manually by an operator, and it may be a hard work to drag the straps away from the boxes.

In food processing industries food objects such as fish can be packed in boxes made of expanded polystyrene (Styrofoam) where a lid is placed on the top of each box, and though there may be some kind of meshing between the box and the lid the lid is often secured by two straps around the box and lid. Such straps are often made of a plastic material. A number of these boxes with straps are arranged close to each other on a pallet and transported to a destination where the content is to be processed. When an operator manually cuts and remove the straps he is subjected to a heavy workload as he pulls away the straps due to friction forces appearing from the small volume between the boxes.

U.S. Pat. No. 5,297,329 describes an apparatus for cutting the string ties of products carried on pallet-like supports has at least one cutting unit with a transverse beam arranged above a line for the conveyance of the pallet-like supports so as to be slidable in a direction which is longitudinal to the conveyance line. The unit is moved at a speed equal to the advancement speed of the pallets. Two trucks are slidably mounted on the transverse beam and support a pair of vertically slidable arms. The arms have a cutting element, for automatically locating the string tie to be cut, and an opposite element for gripping the string tie, which cooperates with the cutting element. Rollers for removing the cut string tie cooperate with the gripping element.

U.S. Pat. No. 4,773,148 describes a method of and apparatus for removing tying band where a portion of an endless tying band around a package is displaced from the package thus defining a space between the portion of the tying band and the package. Then, a guide plate is inserted into the space, and the tying band is pressed by the guide roll against the guide plate to grip the tying band between the guide plate and the guide roll. The tying band which is gripped between the guide plate and the guide roll is then severed by a cutter blade. The guide roll is located to deliver an end of the severed tying band for thereby removing the severed tying band from the package.

DESCRIPTION OF THE INVENTION

On the above background it is an object of embodiments of the present invention to provide a device for removing straps from boxes where the device is capable of automatically engaging with a strap and removing it from the box, securing the strap will not disturb opening the boxes or come into contact with the content of the boxes, and hereby reducing the risk of contaminating the content.

A further object of the present invention is to provide a device for removing straps from boxes which apparatus is simple in concept, safe and reliable in operation as well as possible to use in different arrangements for removing straps from boxes, and where the removal of straps from boxes can be performed during movement of the box and/or of the device.

A first aspect of the invention relates to a device for removing straps from boxes, such as a strap encircling a box, the device may comprise a) at least one tentacle or gripping device for creating contact to a strap which is to be removed from a box, b) at least one first guide for guiding the strap away from the tentacle or gripping device, and c) at least one first guide drive for driving the first guide.

In a preferred embodiment the device comprises a device for removing straps from boxes, such as a strap encircling a box, the device comprises a) at least one tentacle or gripping device for creating contact to a strap which is to be removed from a box,
b) at least one first guide for guiding the strap away from the tentacle or gripping device,
c) at least one first guide drive for driving the first guide and
d) at least one position mechanism connected to the at least one tentacle or gripping device for positioning at least the tentacle or gripping device towards a side of a box and such that the position mechanism can contract to avoid the tentacle or gripping device engages too much with the box.

The boxes with straps around may be of any material, such as of cardboard or plastic. Plastic may be hard plastic or softer plastic e.g. expanded polystyrene. The straps may also be of any material such as metal or plastic, preferred is straps made of plastic. Embodiments of the device is exemplified with removal of plastic straps from boxes made of expanded polystyrene, though it should be understood embodiments of the invention would be suitable of removing straps of other materials than plastic and from boxes of other materials than expanded polystyrene.

The at least one tentacle or gripping device may engage with the strap to be removed by being directed in between the strap and the box. A guide driven by a guide drive may engage with the strap and guide the strap away such as downwardly from the box.

The tentacle or gripping device may comprise a pointed tip making it easier to introduce the tentacle or gripping device between the strap and the box. The box with a strap and the tentacle are moved relative to each other such that the strap and the tentacle reach each other and the tentacle becomes positioned between the strap and the box to catch the strap. By further movement of the device and/or of the box the strap is directed downwards by the tentacle and becomes engaged by a guide guiding the strap away from the tentacle and away from the box. Preferably the strap is cut before or at the time the tentacle or gripping device enters between the strap and the box and starts removing the strap from the box.

The device may further comprise at least one runner or holder for positioning the tentacle or gripping device next to a box. The runner or holder may have a fixed position according to the tentacle or gripping device and may be positioned such that it gets in contact with the box and maintains a certain distance between the runner or holder and the box such that the tentacle or gripper may or may not engage with the box material and such that if the tentacle or gripper engages with the box material it does not enter too deeply into the box material. In this way the holder or runner secures the box is not broken with the risk of the content dropping out or the content being contaminated by an entry of the tentacle or gripping device into the box.

The device may further comprise at least one position mechanism for directing the at least one tentacle or gripping device and the at least one holder or runner towards a box and the at least one position mechanism may also be capable of contracting to reduce a force made between the box and the tentacle or gripping device and/or to reduce the force made between the box and the holder or runner (6). The position mechanism applies a force to the tentacle or gripping device and holder or runner hereby pushing the tentacle or gripping device and the holder or runner towards the box. However, the holder or runner when getting in connection with the box obtains or is influenced by a force from the box and transfer this force as a counterforce to the position mechanism, such that the tentacle or gripping device is held in a certain distance from the box, which may be adjacent to the box. The position mechanism may be any mechanism providing a force to the tentacle or gripping device and to the holder or runner and may be a cylinder, such as a pneumatic cylinder. This force is thus pressing the tentacle or gripping device and the holder or runner towards the box. When the force made by the contact between the box and the holder or runner increases above the force applied by the position mechanism, the position mechanism may contract to avoid the tentacle or gripping device and holder or runner engages too much with the box. For some boxes the tentacle or gripping device or the holder or runner should not be allowed to damage the outer surface of the box material, however, for some types of boxes, such as EPS boxes i.e. thermo boxes made of expanded polystyrene, the tentacle or gripping device or the holder or runner could be allowed to damage the outer surface of the box material without contaminating e.g. food products, such as fish, being transported in the boxes. Such damages may be minor scratches in the outer surface when e.g. a robot transports a box pass a device as described herein to remove straps from the box, and when the box becomes positioned on the tentacle or gripping device and/or on the holder or runner small scratches may be made before the tentacle or gripping device and the holder or runner is pressed to the inside of the device as described elsewhere herein.

The at least one first guide for guiding the strap away from the tentacle or gripping device engages with the strap when it is pulled downwards such as by the tentacle or gripping device. The first guide is driven by a guide drive to pull the strap away from the tentacle or gripping device. The strap may only be directed directly from the tentacle or gripping device to the first guide when the position mechanism is in a contracted position.

In an embodiment the device may further comprise at least one second guide for guiding the strap towards the first guide i.e. guiding the strap from the tentacle or gripping device to the first guide. The second guide is preferably located close to the tentacle to be capable of engaging with a strap when this strap has first engaged with the tentacle. The second guide may be driven by a guide drive. The second guide guides the strap away from the tentacle or gripping device and to the first guide which then further removes the strap from the box. The second guide may comprise at least one carrier to engage with the strap and to overcome the force performed onto the strap while this is positioned around the box, such as partly around the box. The second guide may be a belt, such as a belt with carriers, and running in a direction away from the pointed tip of the tentacle or gripping device which engages with a strap to be removed from a box. The second guide runs towards the first guide to bring the strap to this first guide.

The first guide may comprise two belts each comprising a transport area which are located close to each other such as in close connection to each other and running in directions enabling the belts each to apply a force onto a strap entering in between the two belts and directing the strap away from the second guide or away from the tentacle. The first guide may comprise two members, such as pressing members each capable of transmitting forces to one of the running belts and securing the belts are pressed together and are capable of holding and removing the strap from the box when the belts of the first guide has engaged with a strap. Hereby straps will not escape when being caught by the first guide and will not get into contact with processing equipment or in contact with the content of the box, which may be food that should be secured from being contaminated.

The at least one tentacle or gripping device may comprise a land to be guided towards a box on a box side from where at least one strap is to be removed. The land may have similar function as described in respect of the holder or runners.

In an embodiment the at least one tentacle or gripping device, the at least one holder or runner and the at least one second guide are connected or controlled as a unit in a way such that they simultaneously can be directed towards or away from a box. This movement is performed by the position mechanism as described elsewhere herein i.e. the at least one position mechanism may be directing the at least one tentacle or gripping device, the at least one holder or runner and the at least one second guide towards or away from a box. The unit of the at least one tentacle or gripping device, the at least one holder or runner and the at least one second guide may be considered as a top part of the device, and may be exposed to a force such as from the box when getting in connection with the box and where the force results in the top part being pushed inside the device such that the inlet end of the second guide positioned close to the tentacle or gripping device is at a position of the inlet end of the first guide. Hereby the second guide in such situations need not have any separate function for guiding the strap as the inlet of the first guide may engage with the strap when the strap is directed away from the box by the pointed tip of the tentacle or gripping device. The forces applied by the box towards the tentacle or gripping device and to the holder or runner determines if the top part is in its extended position with no or limited force applied by the box, or the top part is in a contracted position where the force applied by the box is pushing the top part to its contracted position. Any position between extended position and contracted position is possible. Hereby the top part will be in an extended position if the box does not push towards the top part, or if the top part does not push towards a box.

In an embodiment, positioning arms secure the top part when moving down and up stays in the correct position relative to the first guide and such that the device is capable of pulling a strap from the second guide to the first guide while the movement is taking place. The positioning arms are preferably connected to the position mechanism which may amend the position of the positioning arms due to the force provided onto the tentacle or gripping device and to the holder or runner.

Due to the function described above this may correspond to directing the at least one tentacle or gripping device, the at least one holder or runner and the at least one second guide towards or away from a box simultaneously is directing the at least one tentacle or gripping device, the at least one holder or runner and the at least one second guide away or towards the at least one first guide, respectively.

The device of the present invention may be a stand-alone device where boxes with at least one strap which should be removed are directed towards the device described herein. The device may also be positioned between two conveyors e.g. two conveyor belts transporting boxes with at least one strap which should be removed pass the device, or the device may be positioned on a robot arm such that the present device can be directed pass boxes with at least one strap which should be removed. Hereby directing the at least one tentacle or gripping device, the at least one holder or runner and the at least one second guide towards or away from a box simultaneously is directing the at least one tentacle or gripping device, the at least one holder or runner and the at least one second guide away or towards the at least one first guide should be understood in respect of how the device is installed i.e. as a stand-alone device, between conveyors or controlled by a robot. In a system where the device is a stand-alone device and boxes are handled by a robot such that the robot directs the boxes pass the stand-alone device or removing cut straps, the position of the top part during the strap removal is determined by the moving curve of the robot and thus by the forces applied to the top part during the movement.

The device may further comprise a cutting device, where such a cutting device may be located to be capable of cutting a strap before or simultaneously with this strap being in contact with the at least one tentacle or gripping device. Such a cutting device may be connected directly to the device described herein such as connected to the top part of the device and in front of the tentacle or gripping device, though preferably not cutting straight ahead the location of the tentacle or gripping device, but preferably at least 5 cm aside from where the tentacle or gripping device is to engage with the strap, such as at least 10 cm aside. Here 'in front' means the cutting device will engage with a strap to be removed before the tentacle or gripping device gets into contact with the cut strap and close to the position where the tentacle or gripping device is to engage with the strap.

A cutting device may also be positioned to cut a strap on one of the other sides of the boxes where the tentacle or gripping device does not engage with the strap, such as on the opposite side of the box in respect of where the tentacle or gripping device is to engage with a strap.

A second aspect of the invention relates to a system for cutting and removing straps from boxes, such as a strap encircling a box, the system comprises:

A device for removing straps from boxes, and

A cutting device for cutting a strap before or simultaneously with this strap being in contact with the at least one tentacle or gripping device.

Here the device for removing straps from boxes is preferably a device as described herein.

In the system the cutting device comprises a cutting element such as a knife capable of cutting a strap, such as a plastic strap.

The knife preferably has a cutting depth being smaller than the sum of the thickness of the strap to cut with addition of the thickness of the box side with the strap. More preferably the knife has a cutting depth smaller that the thickness of the box side with the strap. Also, the knife may have a cutting depth substantially equal to the thickness of a strap to cut. This should ensure the knife does not cut through the box with the risk objects in the box may drop out, be cut into and/or become contaminated by the knife which during the cutting processes is in contact with the outside of the box.

The system with the device for removing straps from boxes may further comprise an inlet conveyor such as a conveyor belt and an outlet conveyor such as a conveyor belt for conveying boxes with at least one strap towards and boxes without straps away from the device for removing straps from boxes.

In such a system the cutting device may be located under, above or along a side of a box under transport and at a box side having side lengths or widths being parallel to the transport direction.

In an embodiment of the system the device for removing straps from boxes may further comprise a robot connection unit capable of connecting the system to a robot arm with at least four axes.

The system may further comprise a robot arm and a control unit for controlling the robot arm with the device for removing straps from boxes. Preferably the robot can be controlled in at least five axes, such as at least six axes. Preferred is that the robot can control the movement of the device in all dimensions such that the tentacle or gripping device can engage with a strap located around a box. Preferably this can be performed while the device is being moved by the robot arm and/or the box with at least one strap is being moved.

The system may further comprise a vision system for obtaining images of the boxes with straps, and an image processing unit for processing obtained images to perform an output signal being an input signal for the control unit for controlling the robot arm. The processing unit may be based on the obtained images being capable of controlling the movements of the robot arm with the device to remove straps from boxes.

A third aspect of the invention relates to a method of removing at least one strap from a box, where the method comprises the steps of a) Cutting the at least one strap to obtain two ends of each of the at least one strap, b) Removing the at least one cut strap by use of a device for removing straps from boxes.

The method of removing at least one strap from a box may be by using the device or system as described herein or directing by a robot arm at least one box encircled by a strap pass the device as described herein such that the strap engages with the tentacle or gripping device and is removed from the box.

The method of removing at least one strap from a box by using the system may be where the device is a stand-alone device, the device is located between two conveyors, or the device is controlled by a robot.

It should be understood that features described in respect of one aspect may be used for other aspects described herein as well.

DETAILED DESCRIPTION OF THE DRAWINGS

Figure 1:
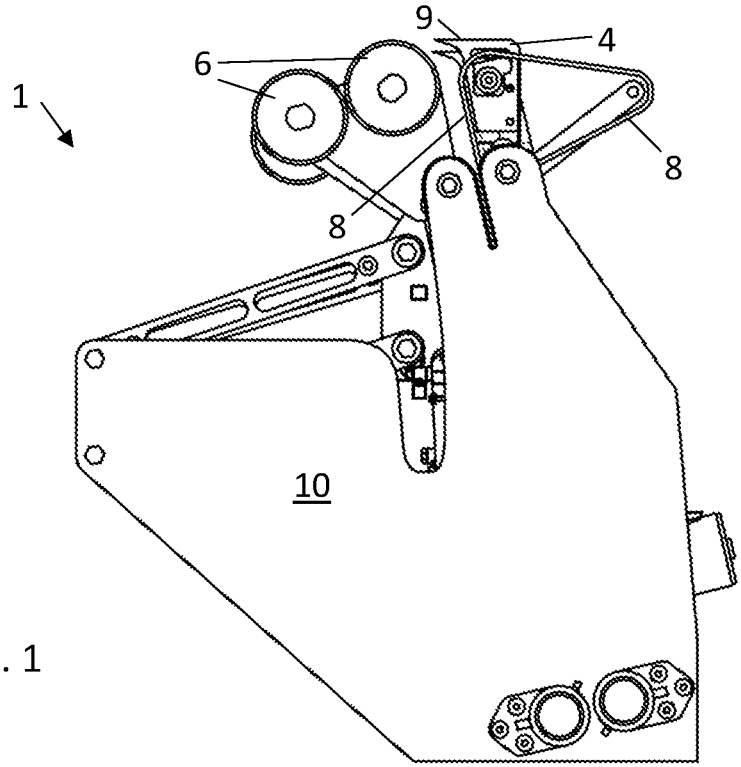
FIG. 1 illustrates a side view of a device for removing straps from boxes.

FIG. 1 illustrates a side view of a device 1 for removing straps from boxes. A gripping device such as tentacle 4 are located to engage with straps when the tentacle 4 and the straps pass each other. A land 9 of the gripping device may make contact with the side of a box from where one or more straps are to be removed. Runners 6 are positioned to get in touch with the outer side of the box, which may be of expanded polystyrene (Styrofoam), and secure the gripping device such as the tentacle 4 do not enter too deep into the box side. Running beneath the tentacle 4 are a second guide 8, which when getting in touch with a strap guides this strap towards and into the lower part of the device 1. The main part of the device 1 is covered by a cover plate 10.

Figure 2:
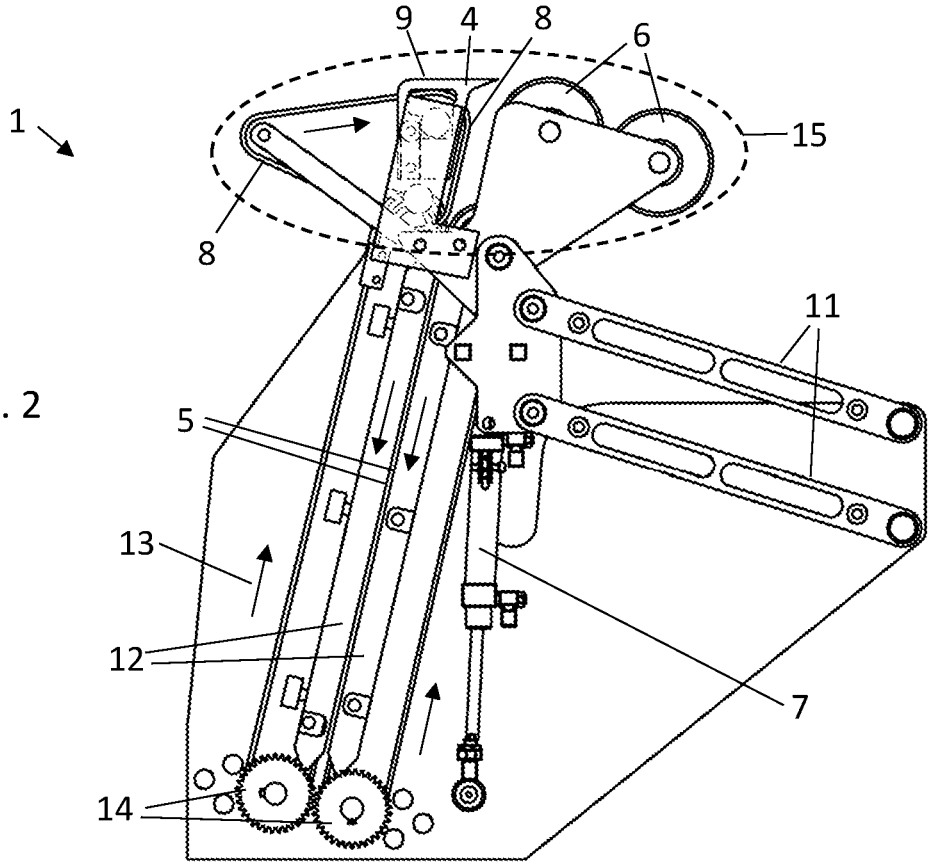
FIG. 2 illustrates a side view of a device for removing straps from boxes, where the cover plate is removed.

FIG. 2 illustrates a side view of a device for removing straps from boxes, where the cover plate as shown in FIG. 1 is removed. The top part of the device is as described in relation to FIG. 1 with tentacle or gripping device 4 with a land 9, holder or runner 6 and a second guide 8 running in the direction of the arrow and guides straps towards and into the lower part of the device 1, where the strap will be guided to the first guide 5, which may be endless belts and running in the direction indicated by the arrows of which one is marked 13. The first guide 5 comprises in this embodiment two units e.g. two belts running in opposite direction and thus pulling in same direction as indicated. A pressing member 12 related to each first guide 5 presses the one part of the first guide 5 towards the other part of the first guide 5 securing a strap will stay in the first guide 5 and that a pulling force is applied to pull the strap away from the box. The first guide 5 is driven by first guide drive 14. The top part 15 of the device which is encircled by the dotted line and comprising the tentacle or gripping device 4, the holder or runners 6 and the second guide 8 is movable connected to the main part of the device below the encircled features. A position mechanism 7 such as a cylinder provides a force to the top part 15 securing the device 1 and especially the tentacles or gripping device 4 gets in contact to a box and straps surrounding the box. The force provided by the position mechanism 7 is adjusted such that the top part 15 moves into the main part of the device 1 to avoid destroying the box, as if this happens objects such as food items may drop out of the box or be contaminated. Positioning arms 11 secure the top part 15 when moving down and up stays in the correct position and is capable of pulling a strap from the second guide 8 to the first guide 5 or if the position mechanism 7 is in a compressed or contracted position and the top part 15 is mostly inside the main part of the device 1 the strap may be caught directly by the first guides 5 after engaged with the tentacle or gripping device 4.

In the shown embodiment the encircled features i.e. the top part 15 can move down such that the second guide 8 is hidden inside the device and only the first guide 5 is used for guiding the strap away from the tentacle or gripping device 4. The device 1 may also be constructed with only the first guide 5 i.e. without the second guide 8 and without the features giving the movable connection between the top part and the main part of the device.

Figure 3:
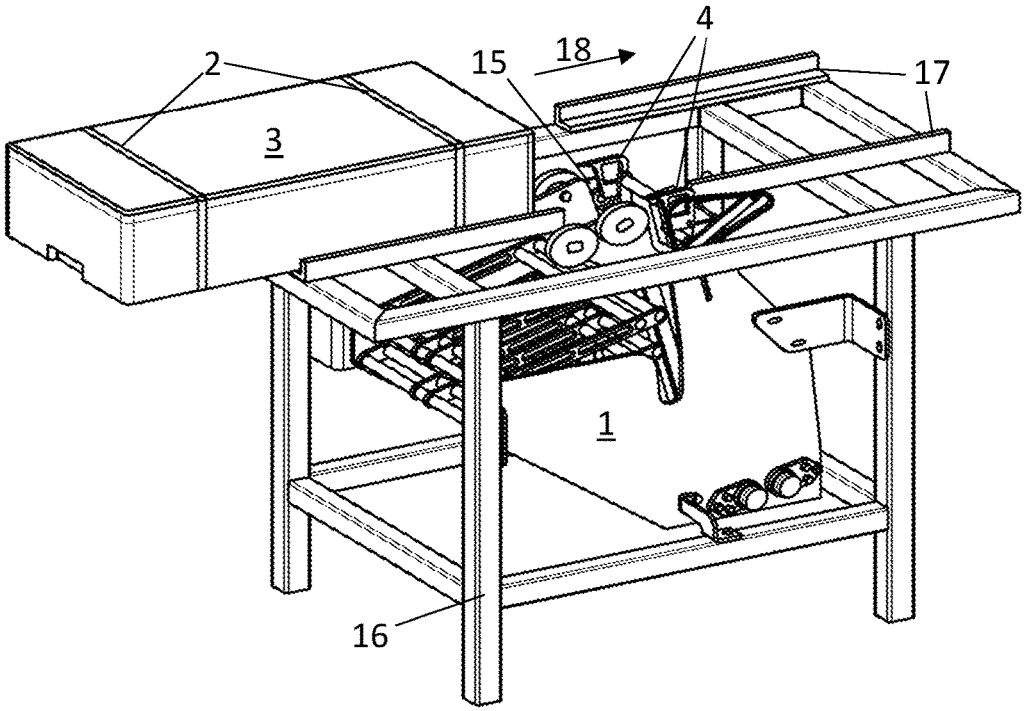
FIG. 3 illustrates the position a system of incoming boxes from where straps are to be removed by a device for removing straps from boxes.

FIG. 3 illustrates the position of incoming boxes 3 from where straps 2 are to be removed by a device 1 for removing straps from boxes. In this embodiment the device 1 for removing straps from boxes is mounted in a frame 16, which may be located in between two conveyors e.g. two conveyor belts or the structure e.g. the frame 16 may support an outfeed end of a first conveyor belt and an infeed end of a second conveyor belt and in a gap between the outfeed end of the first conveyor belt and an infeed end of the second conveyor belt the upper part 15 of the device 1 may be located. In such an embodiment the outfeed end of the first conveyor belt would be located under the box 3 and an infeed end of the second conveyor belt would be located on the other side of the top part 15 of the device 1. The embodiment is illustrated to be capable of handling two boxes 3 at a time, though only one box 3 is shown. Guideways 17 are positioned along each line where boxes 3 are transported. Illustrated are only guideways 17 for the line where a box 3 is located. A cutting device (not shown) may be located on one box side being parallel to the transport direction as indicated by arrow 18. Such a cutting device may e.g. be located to cut the straps 2 at the upper part of the box 3 which with the illustrated box will be at the lid. A strap 2 should preferably be cut before or no later than when a tentacle or gripping device 4 engages with the strap to avoid the box 3 is squeezed together when the device 1 pulls the strap 2 away from the box 3. The movable function of the top part 15 of the device 1 secures a tentacle or gripping device 4 will engage with the strap 2 when passing the tentacle or gripping device 4 and the movable function together with the holder or runner will at the same time secure the tentacle or gripping device 4 does not enter too much into the bottom of the box 3.

Figure 4:
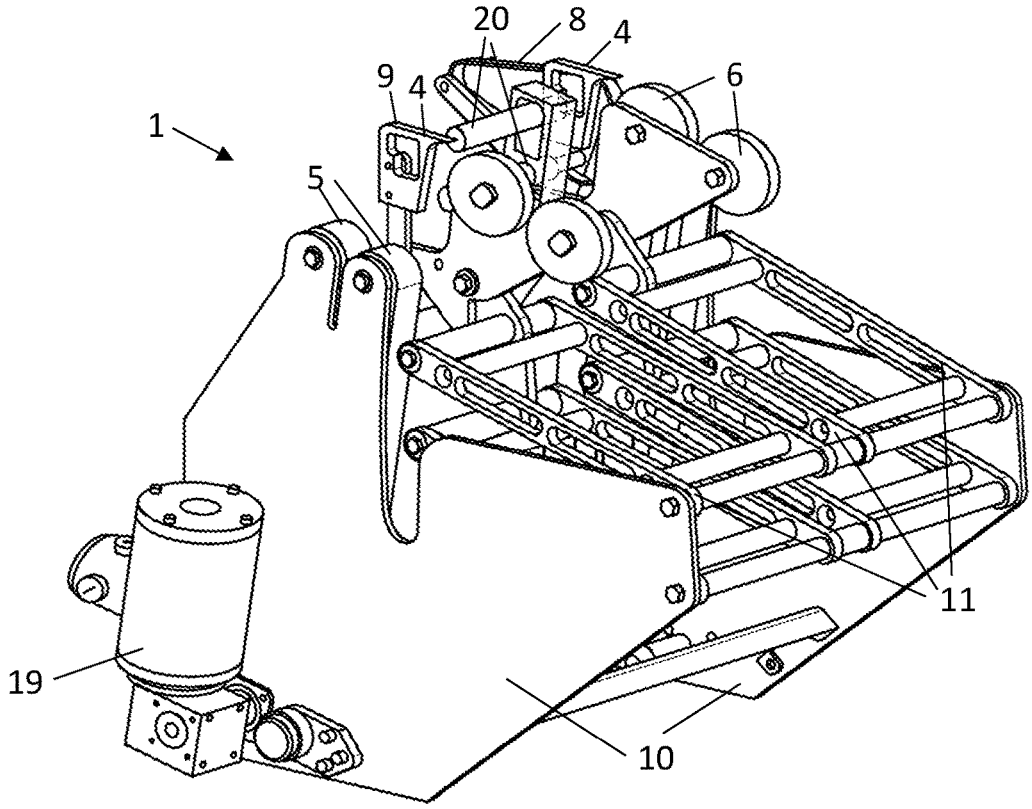
FIG. 4 illustrates a device for removing straps from boxes where two top parts can be integrated in one device.

FIG. 4 illustrates a view of a device 1 for removing straps from boxes, in which device l's two top parts can be integrated in one unit. Only the top part of the device 1 is fully illustrated in the back part and this part is described in respect of FIGS. 1 and 2. Also shown are second guide drives 20 driving the second guide 8. A set of two positioning arms 11 is illustrated for each part of the device 1 as is cover plates 10 on the outside of the device. A motor 19 for powering the first guide drives (not shown) is illustrated.

Figure 5:
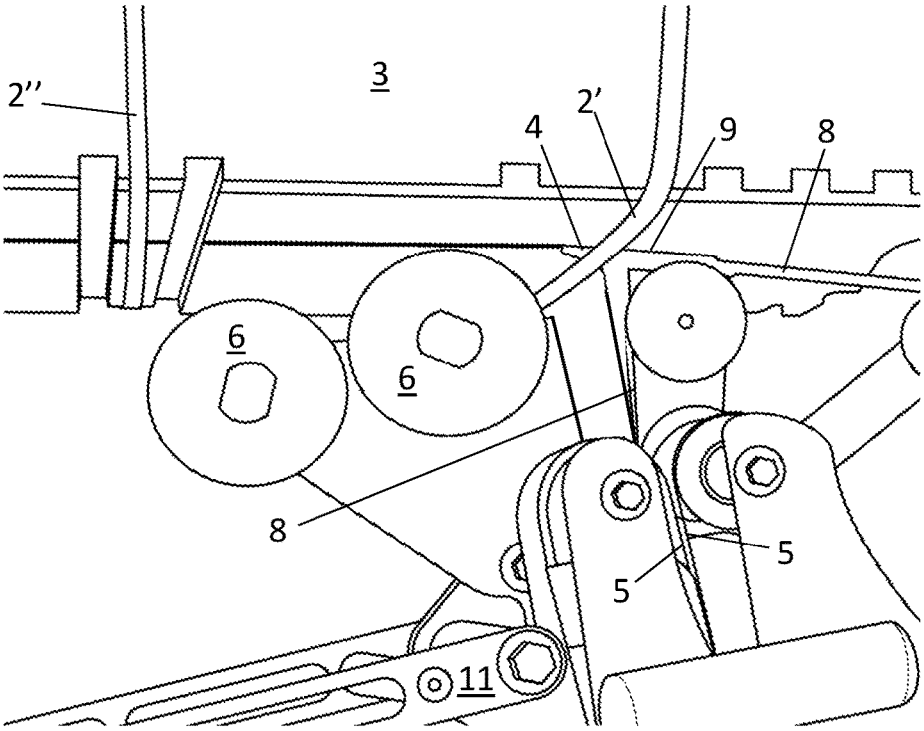
FIG. 5 illustrates a first position of a device for removing straps from boxes having two straps.

FIG. 5 illustrates a first position of a device for removing straps from boxes having two straps 2', 2". A tentacle or gripping device 4 engages with a first strap 2' on a box 3 having two straps 2', 2". At this time the first strap 2' is cut along the lid at the top of the box 3. The device 1 is moving from right towards left and/or the box 3 is moving from left towards right to have the tentacle or gripping device 4 to engage with the first strap 2'.

Figure 6:
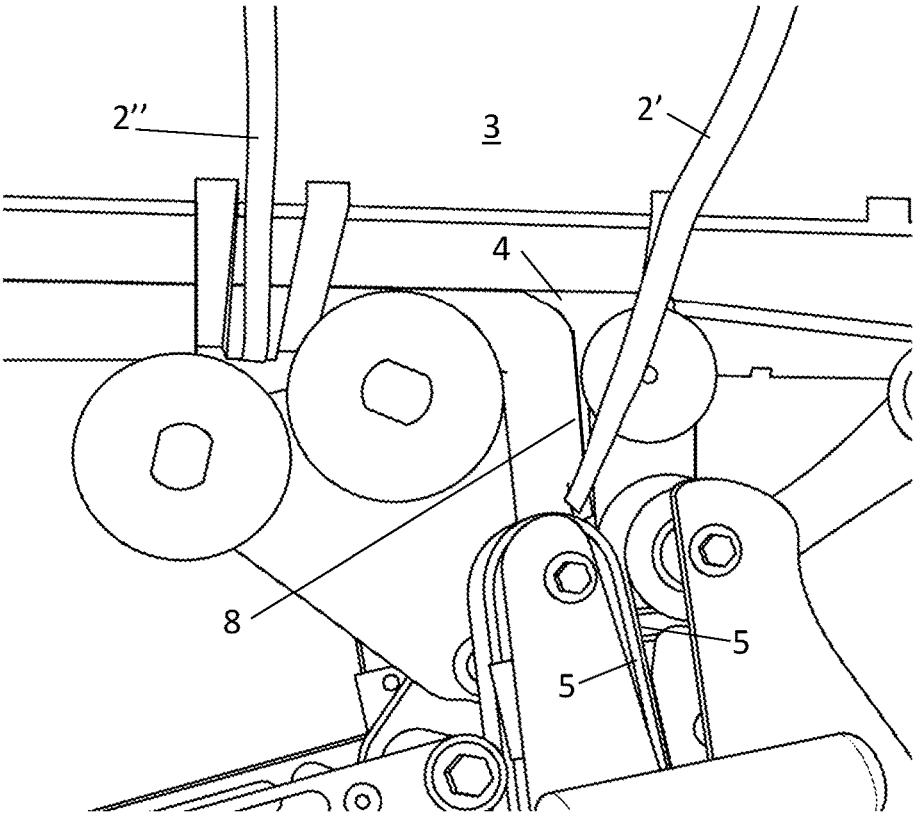
FIG. 6 illustrates a second position of a device for removing straps from boxes having two straps.

FIG. 6 illustrates a second position of a device for removing straps from boxes having two straps 2', 2". The first strap 2' is released from the box 3 and is moved by the second guide 8 towards the first guide 5. The second strap 2" is still around the box 3.

Figure 7:
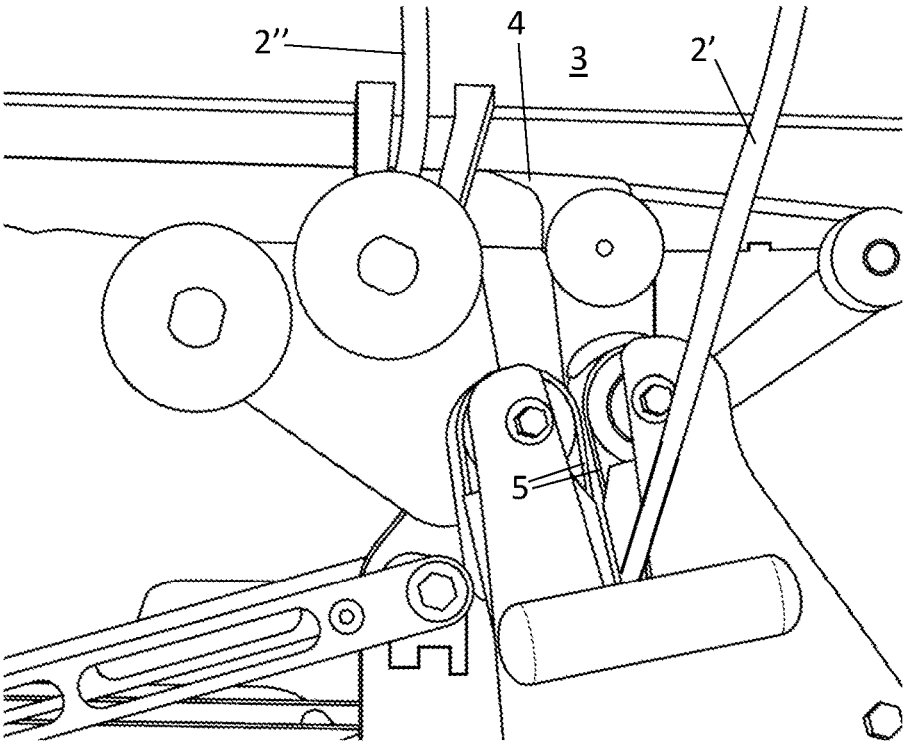
FIG. 7 illustrates a third position of a device for removing straps from boxes having two straps.

FIG. 7 illustrates a third position of a device for removing straps from boxes having two straps 2', 2". The first strap 2' is being pulled away from the box 3 by the first guide 5. The tentacle or gripping device 4 and the second strap 2" is approaching each other, and the second strap 2" may at this time be cut along the lid at the top of the box 3.

Figure 8:
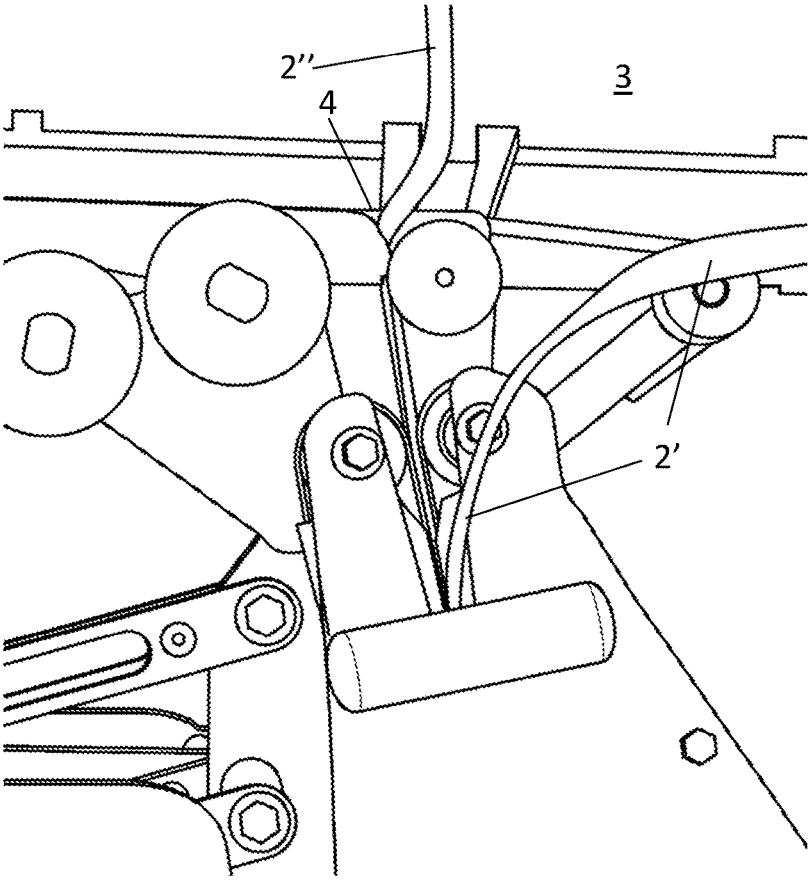
FIG. 8 illustrates a fourth position of a device for removing straps from boxes having two straps.

FIG. 8 illustrates a fourth position of a device for removing straps from boxes having two straps 2', 2". The first strap 2' is fully removed from the box 3 and is pulled away by the first guide 5. The tentacle or gripping device 4 has engaged with the second strap 2" which will be removed in a similar way as described with the first strap 2'.

Figure 9:
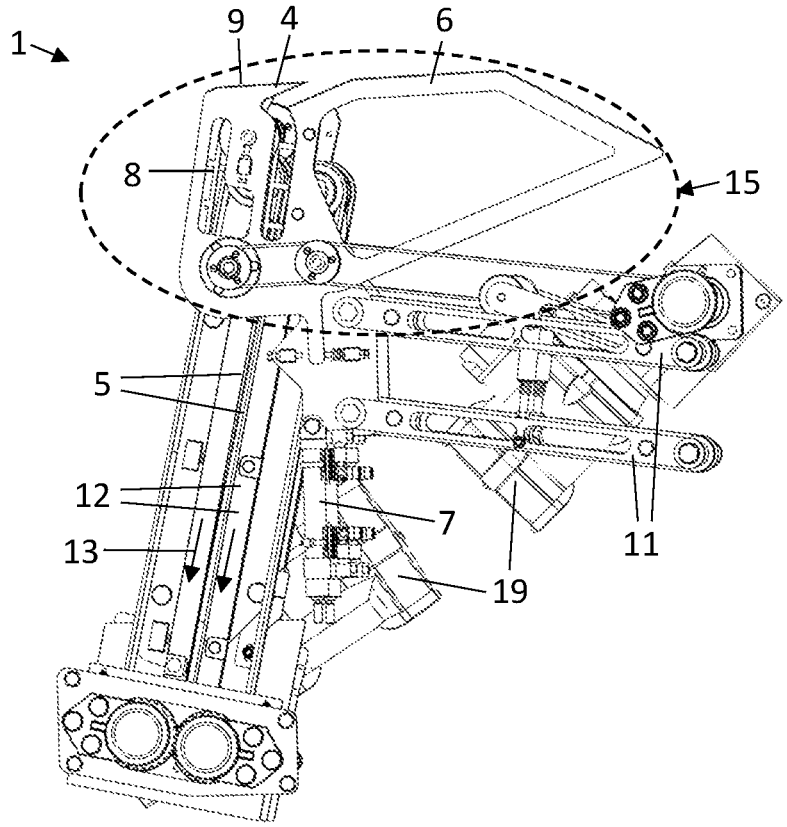
FIG. 9 illustrates a side view of a device for removing straps from boxes, where the cover plate has been removed.

FIG. 9 illustrates a side view of a device for removing straps from boxes from where e.g. the cover plates are removed. Numbers are as in preceding figures. Illustrated is a top part 15 where the holder or runner 6 are solid and can slide along the box when removing a strap from a box. The second guide 8 is illustrated as a band having carriers to drag the strap downwards into the device when the second guide 8 is running. Motors 19 are for driving the first and second guide drives.

Figure 10:
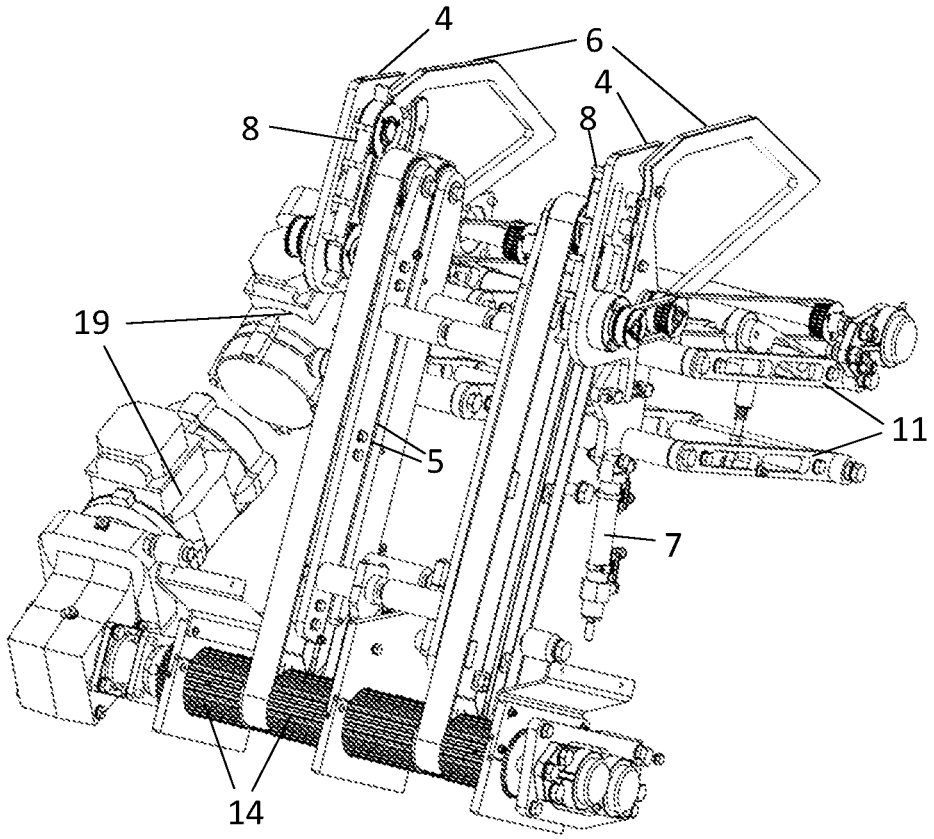
FIG. 10 illustrates a perspective view of a device for removing straps from boxes.

FIG. 10 illustrates a perspective view of a device for removing straps from boxes as shown in FIG. 9. Illustrated is a device capable of removing two straps at a time, which may be two straps from one box or one strap from two different boxes.

Figure 11:
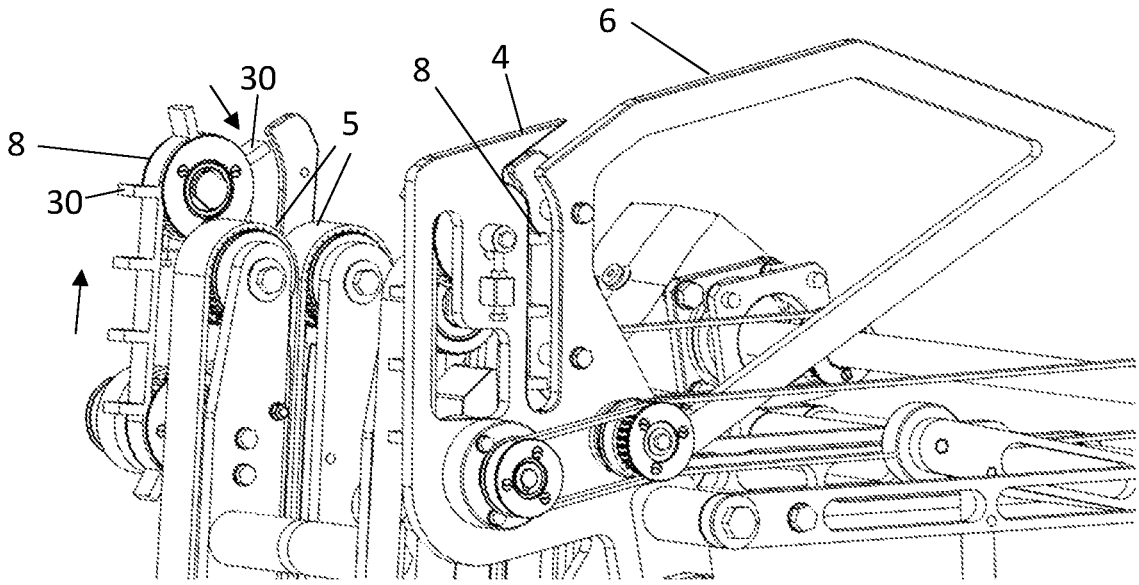
FIG. 11 illustrates an enlarged view of parts of a top part of a device for removing straps from boxes.

FIG. 11 illustrates an enlarged view of parts of a top part of a device for removing straps from boxes. Illustrated is a device capable of removing two straps at a time, though the holder or runner 6 is only present at the part being located in the front. Hereby the second guide 8 and the protruding carriers are clearly illustrated at the part being located in the back. The second guides 8 are in a retracted or push down position with a short distance from the tentacle or gripping device 4 to the first guide 5. As indicated by the length of the second guide 8, this part can be located further upwards and still being capable of directing straps from the tentacle or gripping device 4 to the first guide 5 by the action of the second guide 8. The second guide 8 is driven by a second guide drive in the direction of the arrows. Carriers 30 are illustrated on the second guide 8.

Figure 12:
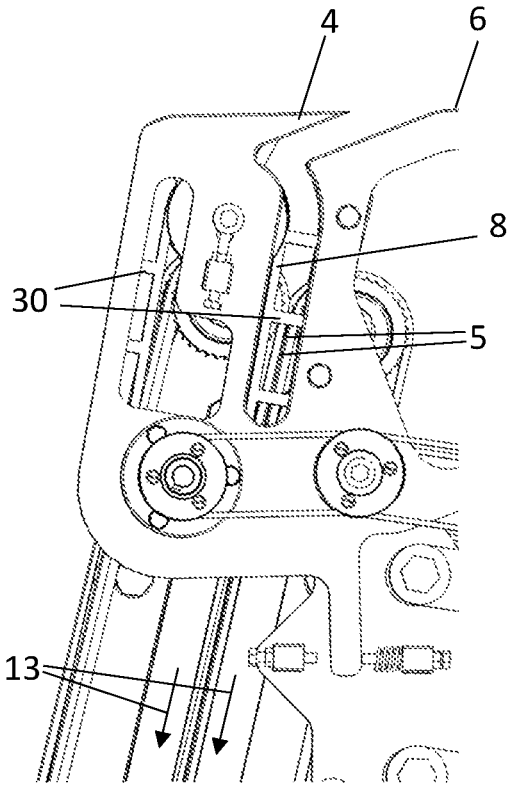
FIG. 12 illustrates an enlarged view of the upper part of a device for removing straps from boxes.

FIG. 12 illustrates an enlarged view of the upper part of a device for removing straps from boxes where straps are being caught and drawn away from a box. Shown is an inlet opening between the holder or runner 6 and the tentacle or gripping device 4. When a strap (not shown) is directed downwards by the tentacle or gripping device 4, a carrier 30 of the second guide 8 engages with the strap and due to the running effect of the second guide 8 directs the strap further downwards towards the first guide 5 where the two running guides will further drag the strap downwards in the direction of the arrows 13 indicating the running direction of the first guide 5.

Figure 13:
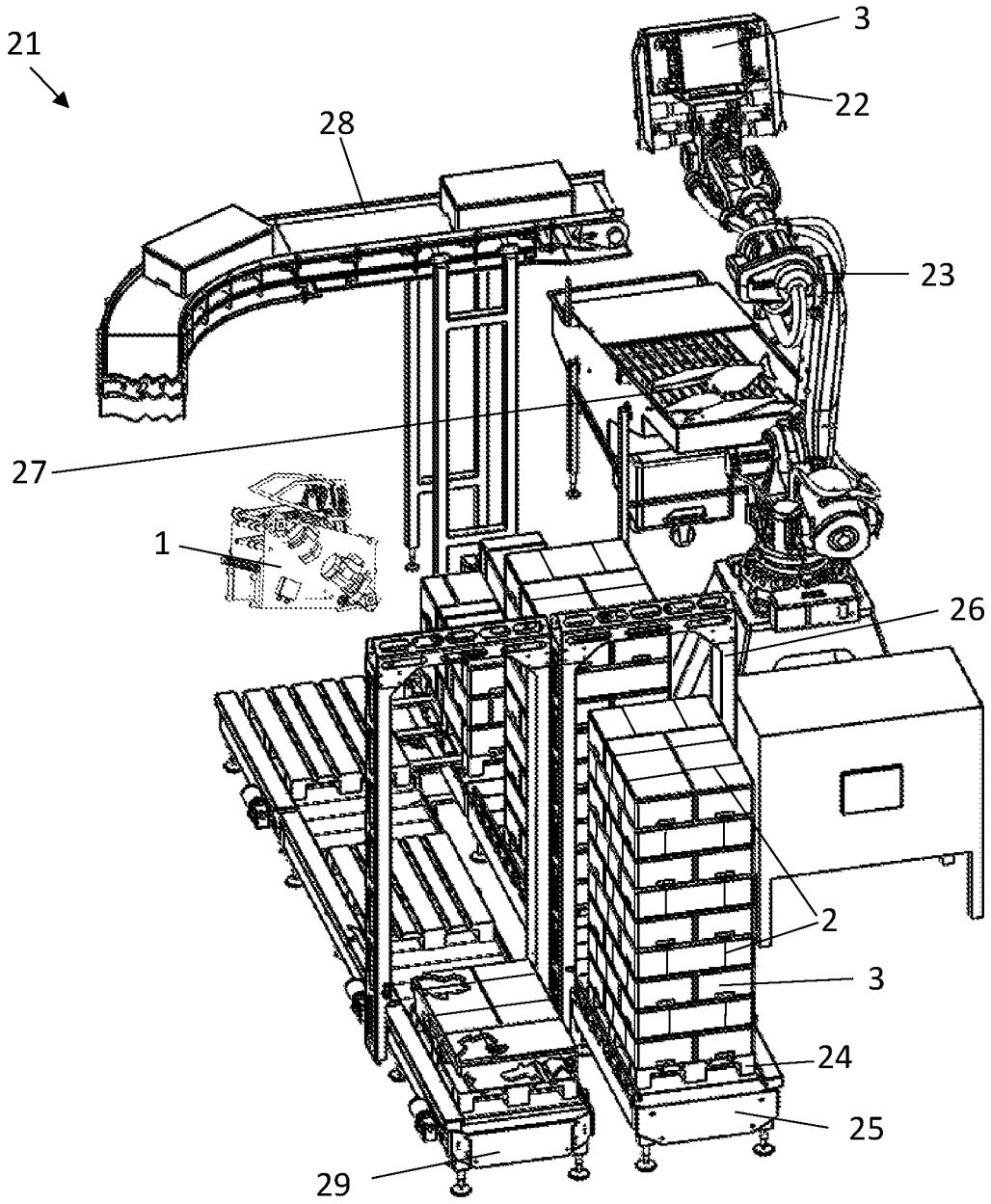
FIG. 13 illustrates a part of a processing line where boxes are opened, and straps are removed from the boxes before the boxes are emptied.

FIG. 13 illustrates a part of a processing line where boxes are opened, and straps are removed from the boxes. Shown is a system 21 arranged for opening and emptying EPS boxes 3 having a body part and a lid, the system furthermore being arranged for removing one or more food items, such as fish and ice from the boxes. When entering the system, the boxes 3 are surrounded by one or two straps 2 located in the vertical plane around the boxes to secure the lid to the body part. The system comprises a gripper 22 for handling one or two boxes at a time, and the gripper comprises holding means for holding the body part and holding means for holding the lid. The holding means for holding the lid may also comprise one or more knives suitable to cut the straps located around the boxes. The holding means of the gripper 22 are arranged for orienting and/or displacing the lid with respect to the body part so as to open the box with the lid, and orienting the body part (e.g., by turning it upside down) so as to allow gravity to remove the one or more food items from the box. The figure furthermore shows a robot 23 whereupon both holding means for holding the body part and the lid are mounted. Boxes 3 are generally arranged on pallets 24 and located in a pallet infeed conveyor 25, which conveys through an entry gate 26, whereupon sensors are arranged for detecting an arrangement of boxes 3 on pallet 24, which arrangement is provided to a processor for controlling the robot 23. Once boxes 3 are ready for emptying, the gripper 22 grips body part and the lid part of one or two boxes. The robot then lifts the boxes, cuts the straps located around the box 3, and directs the box 3 towards and pass a device 1 for removing straps to remove the straps from the boxes, and then proceed to a receiving area 27 (showing fish having been emptied out of preceding box) where the items such as fish are directed out of the box 3. Emptied boxes are placed on a box outfeed conveyer 28. Emptied or partially emptied pallets can be removed by pallet outfeed conveyor 29. Boxes which should not have content removed e.g. due to defect boxes may be located on the pallet outfeed conveyor 29.

It should be understood that the detailed description and specific examples, while indicating embodiments of the invention, are given by way of illustration only, since various changes and modifications within the spirit and scope of the invention will become apparent to those skilled in the art from this detailed description.

The invention claimed is:

1. A device for removing straps from boxes, the device comprising:

a) at least one tentacle or gripping device for creating contact to a strap which is to be removed from a box, b) at least one first guide for guiding the strap away from the tentacle or gripping device, c) at least one first guide drive for driving the first guide, d) at least one position mechanism connected to the at least one tentacle or gripping device for positioning at least the tentacle or gripping device towards a side of the box and wherein the position mechanism can contract to avoid the tentacle or gripping device engages too much with the box, and e) at least one holder or runner for positioning the tentacle or gripping device next to the box, wherein the at least one position mechanism is configured for directing the at least one tentacle or gripping device and the at least one holder or runner towards the box.

2. The device according to claim 1, wherein the at least one position mechanism is further capable of contracting to reduce a force made between the box and the tentacle or gripping device and/or to reduce the force made between the box and the holder or runner.

3. The device according to claim 1, further comprising at least one second guide for guiding the strap towards the first guide.

4. The device according to claim 1, wherein the at least one tentacle or gripping device comprises a land to be guided towards the box on a box side from where at least one strap is to be removed.

5. The device according to claim 1, wherein the at least one tentacle or gripping device, the at least one holder or runner and the at least one second guide are connected or controlled in a way such that they simultaneously can be directed towards or away from the box.

6. The device according to claim 3, wherein the at least one position mechanism is directing/positioning the at least one tentacle or gripping device, the at least one holder or runner and the at least one second guide.

7. The device according to claim 1, further comprising a cutting device located to be capable of cutting the strap before or simultaneously with this strap being in contact with the at least one tentacle or gripping device.

8. A system for cutting and removing straps from boxes, the system comprising:

a) a device for removing straps from boxes according to claim 1, b) a cutting device for cutting the strap before or simultaneously with this strap being in contact with the at least one tentacle or gripping device.

9. The system according to claim 8, wherein the cutting device comprises a knife capable of cutting the strap, a plastic strap.

10. The system according to claim 8, wherein the system further comprises an inlet conveyor or inlet conveyor belt and an outlet conveyor or outlet conveyor belt for conveying boxes with at least one strap towards and boxes without straps away from the device for removing straps from boxes.

11. The system according to claim 10, wherein the cutting device is located under, above or along a side of the box under transport and at the box side having side lengths or widths being parallel to the transport direction.

12. The system according to claim 8, further comprising:

a robot connection unit capable of connecting the system to a robot arm with at least four axis, the robot arm, and a control unit for controlling the robot arm with the device for removing straps from boxes, and/or a vision system for obtaining images of the boxes with straps, and an image processing unit for processing obtained images to perform an output signal being an input signal for the control unit for controlling the robot arm, wherein the robot arm controls the movement of the device in all dimensions such that the tentacle or gripping device can engage with the strap located around the box.

13. A method of removing at least one strap from a box, comprising:

a) cutting the at least one strap to obtain two ends of each of the at least one strap, b) removing the at least one cut strap by use of the cutting device of claim 1.

14. The method according to claim 13, using a system for cutting and removing straps from boxes including a cutting device for cutting the strap before or simultaneously with this strap being in contact with the at least one tentacle or gripping device, or directing by a robot arm at least one box encircled by the strap to engage the strap with the tentacle or gripping device and remove the strap from the box.

* * * * *